United States Patent [19]

Herriott

[11] 4,346,924

[45] Aug. 31, 1982

[54] RELEASABLE FASTENING DEVICE

[75] Inventor: Leslie V. Herriott, Wolverhampton, England

[73] Assignee: Lowe and Fletcher Limited, Walsall, England

[21] Appl. No.: 135,696

[22] Filed: Mar. 31, 1980

[30] Foreign Application Priority Data

Apr. 12, 1979 [GB] United Kingdom ..... 7913091

[51] Int. Cl.[3] ..... E05C 3/06

[52] U.S. Cl. ..... 292/129; 70/289; 206/1.5; 292/106

[58] Field of Search ..... 292/207, 129, 106, 252, 292/DIG. 48, 229, 216, 99, 241; 70/289, 76; 206/1.5; 190/41

[56] References Cited

U.S. PATENT DOCUMENTS 1,733,772 10/1929 Battershell ..... 206/1.5

2,399,302 4/1946 Thiele ..... 292/106 X 2,659,228 11/1953 Ducharme ..... 70/289 X 4,208,837 6/1980 Black, Sr. et al. ..... 292/216 X

FOREIGN PATENT DOCUMENTS 16566 of 1891 United Kingdom ..... 292/99

*Primary Examiner*—Richard E. Moore

*Attorney, Agent, or Firm*—Merriam, Marshall & Bicknell

[57] ABSTRACT

A briefcase is provided with a two-part releasable fastening device, the first part of which includes a movable fastening member for releasably fastening the parts together. The first part of the device further comprises a ball which, when the case is inverted, is urged by gravity into a retaining position in which it prevents releasing movement of the fastening member. When the lid of the case is uppermost, the ball permits movement of the fastening member to release the second part of the device.

2 Claims, 4 Drawing Figures

RELEASABLE FASTENING DEVICE

BACKGROUND OF THE INVENTION

The present invention relates to a releasable fastening device comprising first and second parts whereof the first part includes a body and a fastening member mounted in the body for movement relative thereto between a fastening position in which the fastening member engages the second part to fasten same in a predetermined position relative to the body and a releasing position in which it does not so engage the second part. Fastening devices of this kind are commonly fitted to luggage and other portable articles for fastening a lid in a closed position.

The fastening member of a device of the kind referred to may be a bolt or a latch. Fastening devices of the kind referred to commonly include a lock mechanism for controlling movement of the fastening member between its fastening and releasing positions.

SUMMARY OF THE INVENTION

According to the invention, the first part of a fastening device of the kind referred to comprises a retaining element which is engageable with the fastening member and the retaining element and fastening member are relatively movable under the action of gravity from a retaining position in which the retaining element retains the fastening member in its fastening position to an inactive position in which the retaining element allows the fastening member to move from its fastening position to its releasing position.

When the attitude of the device is such that gravity causes relative movement of the retaining element and fastening member to the retaining position, the fastening member cannot be moved to permit separation of the second part of the device from the first part. When applied to a briefcase, the device can be arranged to prevent opening of the briefcase whilst inverted. Briefcases comprising a base and a lid which is of generally similar appearance to the base are common and it is not unusual for such briefcases to be opened while inverted so that the contents are spilled or deranged. The present invention enables this to be avoided.

The fastening member is preferably constrained against movement relative to the body under the action of gravity and the retaining element is movable under the action of gravity between the retaining position and the inactive position.

The fastening member may comprise two or more relatively movable parts which are moved together to the releasing position by a user but one of which can return to the fastening position independently of the other part or parts of the fastening member.

The retaining element is preferably inaccessible from the outside of the body. The retaining element may be movable out of its retaining position only by gravity.

The retaining element is preferably capable of rolling from the retaining position to the inactive position.

The retaining element is preferably a rolling element, for example a ball or a cylindrical roller.

DETAILED DESCRIPTION

Figure 1:
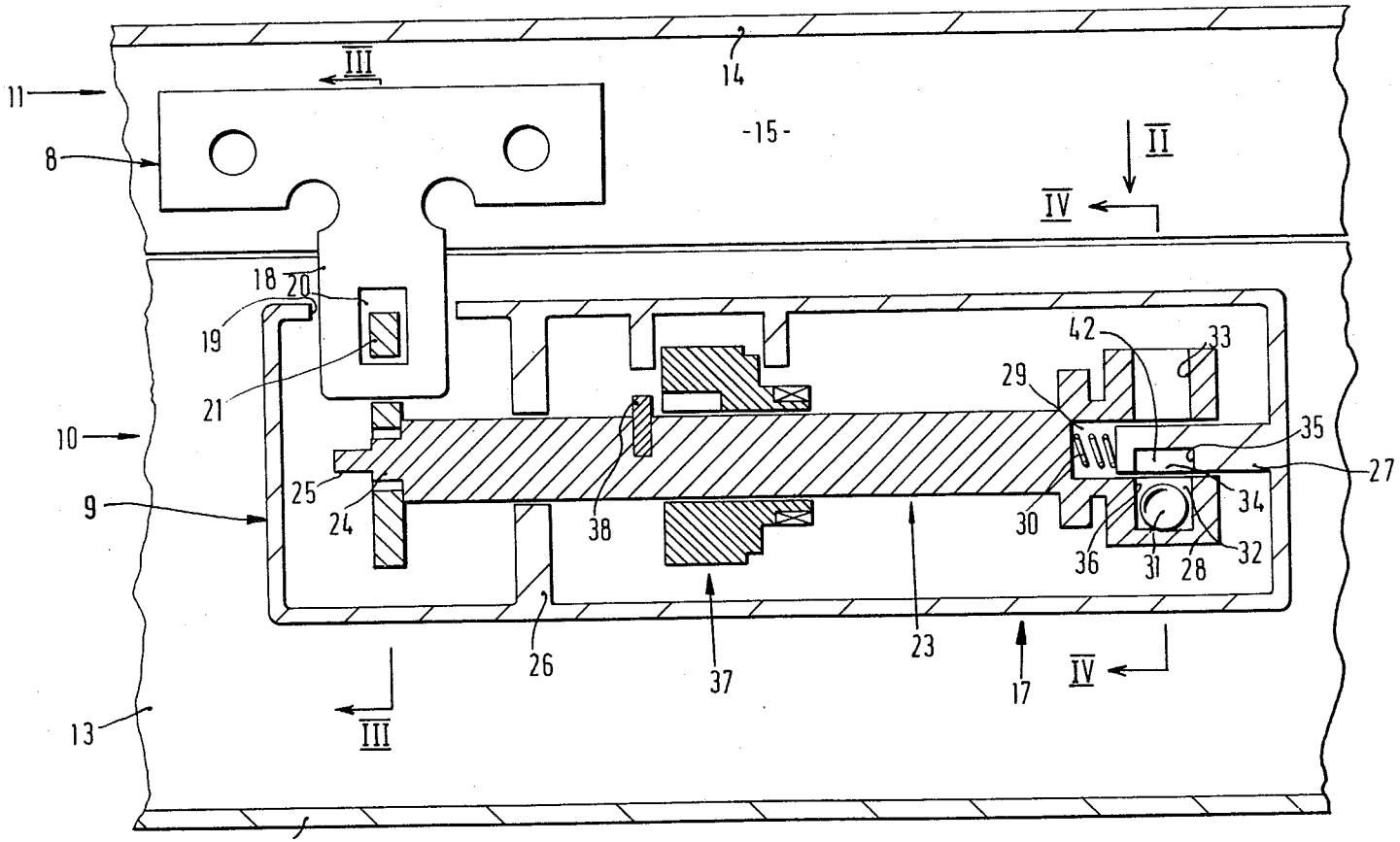
FIG. 1 shows a fragmentary cross-section of one example of a container incorporating a fastening device according to the invention, the device being viewed from within the container and part of the container being omitted.

The container illustrated in the accompanying drawings is a briefcase comprising a base 10 and a lid 11 connected thereto by a hinge (not shown). The base comprises a bottom wall 12 and a peripheral wall 13 while the lid comprises a top wall 14 and a peripheral wall 15. When the lid is in the closed position illustrated in FIG. 1, the peripheral walls 13 and 15 are in edge-to-edge abutting relation.

A two-part fastening device is provided for releasably fastening the lid 11 in a closed position with respect to the base 10. A first part 9 of the fastening device is mounted in an aperture 16 in the peripheral wall 13 and lies mainly within the case when the lid is closed, although certain components of the first part of the device are accessible from the exterior of the case through the aperture 16 as will be described hereinafter.

A second part 8 of the fastening device is attached to the inside of the peripheral wall 15 and lies entirely within the case when the lid is closed.

The first part 9 of the device includes a body 17 which is rigidly secured, for example by rivets, to the peripheral wall 13 to overlie the aperture 16. The second part 8 of the device includes a hasp 18 which projects downwardly from the peripheral wall 15 into the body 17 through an aperture 19 thereof when the lid is closed.

Figure 3:
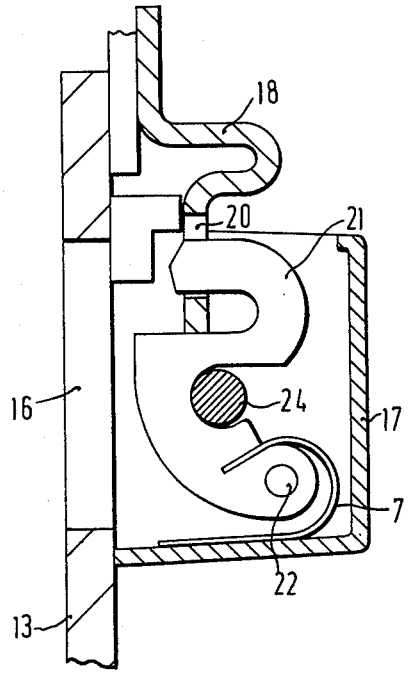
FIG. 3 shows a cross-section on the line III-III of FIG. 1.

The first part 9 of the device further comprises a fastening member 23 provided with means in the form of a hook 21 for fastening the part 8 of the device in a predetermined position relative to the part 9 in which position the peripheral walls 13 and 15 are in mutually abutting relation. The hook 21 is mounted in the body 17 for pivoting about an axis 22 in directions towards and away from the peripheral wall 13. The hasp 18 is formed with an eye 20 in which the hook can engage. As shown in FIG. 3, the hasp is arranged to engage the hook 21 at a position spaced from the peripheral wall 13 by a shorter distance than the axis 22 is spaced from the peripheral wall. As the lid 11 is moved into the closed position, the hasp enters the body 17 through the aperture 19 and then pivots the hook 21 until the hook engages in the eye 20. The hook is then held releasably by the fastening member 23 in the position shown in FIG. 3 in which the hook is engaged in the eye 20 and thereby prevents opening of the lid 11.

The fastening member 23 is in the form of a bolt which is slidable relative to the body 17 along a path parallel to the axis 22 between a fastening position illustrated in FIG. 1 and a releasing position (not shown). In the fastening position, an end portion 24 of the bolt engages the hook 21 at a position spaced from the axis 22 to constrain the hook against pivoting in a direction to withdraw the hook from the eye 20. In the releasing position of the bolt, a portion 25 which is adjacent to the end portion 24 and has a smaller diameter is disposed adjacent to the hook and permits limited pivoting of the hook, sufficient to withdraw the hook from the eye 20. A torsion spring 7 is provided for urging the hook to pivot in a direction to withdraw the hook from the eye 20 and thereby release the lid 11. Such pivoting also moves the lid somewhat away from the base 10 since motion is transmitted from the hook through the hasp 18 to the lid.

The bolt 23 is guided for movement between its fastening and releasing positions by two webs, 26 and 27 respectively, of the body 17. The web 26 extends transverse to the direction of movement of the bolt and is formed with an opening in which the bolt is received with sliding clearance. The web 27 is arranged with its length parallel to the direction of movement of the bolt. The bolt includes a large diameter end portion 28 remote from the end portion 24. The end portion 28 is formed with a diametrical slot 29 which extends along the bolt a part of the way from the end portion 28 towards the end portion 24. The web 27 is received within the slot 29 with sliding clearance and thereby constrains the bolt against rotation about its longitudinal axis. That part of the bolt which lies between the end portions is preferably cylindrical. A spring 30 is disposed in the slot 29 between the web 27 and an inner end of the slot. This spring urges the bolt towards its fastening position.

A retaining element is provided for retaining the bolt 23 in its fastening position whilst the case is inverted so that the lid 11 is below the base 10. The fastening element is in the form of a ball 31 which, when the lid 11 is uppermost, lies within a recess 32 provided in the larger end portion 28 of the bolt. The recess 32 is constituted by an end portion of a passage 33 formed in the end portion 28 and extending from the periphery thereof across and beyond the slot 29. A longitudinal axis of this passage is perpendicular to the direction of movement of the bolt 23. The ball 31 is placed in the recess 32 prior to reception of the web 27 in the slot 29. The recess is then effectively closed by the web 27.

There is formed in the web 27 a recess 34 which, when the bolt is in its fastening position, is aligned with the passage 33. In this position of the bolt, the ball 31 can move under the influence of gravity from an inactive position shown in FIG. 1, in which the ball lies entirely within the recess 32, to a retaining position in which at least one half of the ball lies in the recess 34 and the remainder of the ball lies within the recess 32. When in its retaining position, the ball engages with abutment surfaces 35 and 36 on the body and bolt respectively to restrain movement of the bolt towards its releasing position.

As is shown in FIG. 1, the recess 32 is at the side of the web 27 which is remote from the lid 11. Accordingly, when the lid 11 is above the base 10, the ball 31 is disposed entirely within the recess 32 and does not interfere with movement of the bolt 23.

Figure 4:
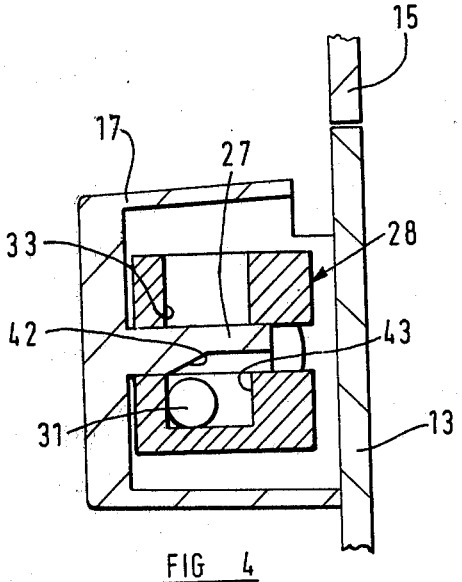
FIG. 4 shows a cross-section on the line IV-IV of FIG. 3 with parts remote from the line IV-IV being omitted.

As shown in FIG. 4, the dimension of the recess 32 which extends in a direction from the end portion 28 towards the peripheral wall 13 is considerably greater than the diameter of the ball 31, typically twice that diameter. Accordingly, if the case is re-orientated so that the peripheral wall portions which bear the parts 8 and 9 of the fastening device are uppermost, the ball 31 can move under the influence of gravity in a neutral direction from the inactive position shown in FIG. 1 to the further inactive position shown in FIG. 4. On the web 27 there is provided a ramp 42 which defines a boundary of the recess 34 extending from the active position of the ball 31 in a direction away from the peripheral wall 13. When the case is oriented with the portions of the peripheral walls 13 and 16 bearing the fastening device uppermost, the ramp 42 guides the ball 31 out of the recess 34 into the recess 32 so that the ball allows movement of the bolt 23. The ramp 42 and a further boundary surface 44 of the recess 34 which is adjacent to the ramp and, like the ramp faces towards the recess 32, are mutually inclined at an angle of approximately 30°, the surface 44 being perpendicular to the peripheral walls 13 and 15.

An abutment surface 43 on the end portion 28 of the bolt and an abutment surface 44 on the web 27 prevent movement of the ball 31 from its retaining position in a direction away from the ramp 42.

The particular example of device illustrated in the accompanying drawings includes a combination lock mechanism for controlling movement of the bolt 23 between its fastening and releasing positions. A known lock mechanism may be provided. By way of illustration, there are shown in the drawings certain parts only of a combination lock mechanism. Other parts have been omitted for clarity.

The lock mechanism includes a plurality of settable members, one of which is shown at 37. Each settable member is of annular form, encircles the bolt 23, is constrained against movement relative to the body 17 along the bolt and is rotatable about the axis of the bolt. Adjacent to each settable member there projects radially from the bolt a respective lug, one of which is shown at 38. In the inner periphery of each settable member, there is formed a recess which can receive the lug when the settable member occupies a predetermined angular position relative to the bolt. If the settable member is in some other angular position, engagement of the lug with an axially presented surface of the settable member prevents movement of the bolt from its fastening position to its releasing position.

For turning the settable members about the axis of the bolt 23, there is provided for each settable member an associated wheel, one of which is shown at 39. The wheels are mounted in a carrier 40 which is accessible through the aperture 16 in the peripheral wall 13. A part of the periphery of each wheel protrudes through the carrier so that a user can apply torque to the wheel. Such torque is transmitted to the associated settable member by intermeshing ribs on the wheel and settable member.

The carrier 40 is mounted in the body 17 for limited sliding movement relative thereto in a direction parallel to the direction of movement of the bolt 23. The carrier 40 includes a fork 41 in which there is received a part of the end portion 28 of the bolt so that motion in directions parallel to the axis 22 can be transmitted between the carrier and the bolt. When the settable members have been set to their proper positions, a user can move the bolt to its releasing position by applying a force to the carrier. The protruding parts of the wheels 39 facilitate this.

It will be noted that the carrier 40 is constrained to move with the bolt 23 between its fastening and releasing positions. Thus, the retaining element could alternatively be associated with the carrier 40. In a further alternative arrangement, the larger end portion 28 of the bolt may be structurally separate from the remainder of the bolt and connected therewith by means providing some lost motion. With this arrangement, the end portion 28 may return from the releasing position whilst the remainder of the bolt remains in the releasing position. The ball 31 would be associated with the end portion 28 as shown in FIG. 1, to prevent movement of the end portion relative to the body whilst the case is inverted.

The ball 31 is adapted to roll along the passage 33. There may be substituted for the ball some other rolling element, for example a cylinder, arranged to roll between its retaining and inactive positions. The ball 31 is inaccessible from the exterior of the body 17 and is movable between its retaining and inactive positions only by the influence of gravity.

Figure 2:
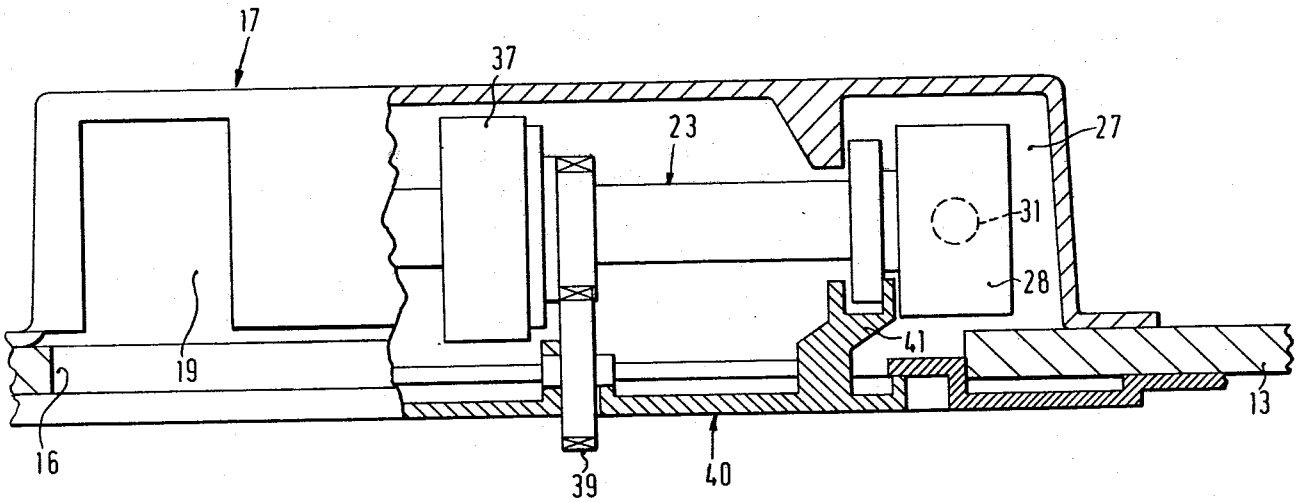
FIG. 2 shows a view of the device on the arrow II of FIG. 1, a part of a body of the device being omitted to reveal internal parts and only one wall of the container being shown.

As can be seen from FIG. 2, a part of each wheel 39 and a part of the carrier 40 lie outside the case and further parts of these components lie in the aperture 16. The remainder of the fastening device lies inside the case where it is protected by the base 10 and lid 11. In particular, that part of the hasp 18 which extends from the peripheral wall 15 to the body 17 is inaccessible when the lid is closed. Thus, the hasp of the device cannot easily be damaged sufficiently to enable the case to be opened.

I claim:

1. A container comprising a base, a lid hinged to the base and a fastening device, wherein the base and the lid each comprise respective peripheral walls which abut when the container is closed, the fastening device comprises first and second parts which are secured to respective ones of the base and lid, the first part of the fastening device includes a body and a further member mounted in the body for movement relative thereto between a fastening position and a releasing position, the fastening member having means for fastening the second part of the device in a predetermined position relative to the body when the fastening member is in its fastening position, the fastening device further comprises a combination lock mechanism for releasably locking the fastening member in its fastening position, the first part of the fastening device further comprises a retaining element which is engageable with the fastening member and is movable relative thereto and relative to the body under the action of gravity from a retaining position in which the retaining element retains the fastening member in its fastening position to an inactive position in which the retaining element allows the fastening member to move from its fastening position to its releasing position, there is formed in one of the fastening member and the body a first recess defined, in part, by first and second boundary surfaces, there is formed in the other of the fastener member and body a second recess which is larger than the retaining element, said first boundary surface is perpendicular to said peripheral walls and faces towards the second recess, said second boundary surface is inclined to said first boundary surface and to said peripheral walls, said second boundary surface also faces towards the second recess, the retaining element is movable within the first and second recesses and the distance between said first boundary surface and a mouth of the second recess is less than the corresponding dimension of the retaining element.

2. A container according to claim 1 wherein said first and second boundary surfaces are mutually inclined at an angle of approximately 30°.

* * * * *